United States Patent [19]

Makimura

[11] Patent Number: 5,062,573

[45] Date of Patent: Nov. 5, 1991

[54] NOZZLE STRUCTURE IN ELECTROMAGNETIC FUEL INJECTOR

[75] Inventor: Toshiro Makimura, Obu, Japan

[73] Assignee: Aisan Kogyo Kabushiki Kaisha, Obu, Japan

[21] Appl. No.: 496,317

[22] Filed: Mar. 20, 1990

[30] Foreign Application Priority Data

May 29, 1989 [JP] Japan ..... 1-135226

[51] Int. Cl.[5] ..... F02M 61/00

[52] U.S. Cl. ..... 239/533.12; 239/585

[58] Field of Search ..... 239/585, 533.3, 533.12, 239/553

[56] References Cited

U.S. PATENT DOCUMENTS

| | | | |
|---|---|---|---|
| 4,057,190 | 11/1977 | Kiwior et al. | 239/533.12 |
| 4,771,948 | 9/1988 | Furukawa et al. | 239/585 |
| 4,903,898 | 2/1990 | Kind | 239/533.12 |
| 4,907,745 | 3/1990 | Messingschlager | 239/585 |

FOREIGN PATENT DOCUMENTS

| | | | |
|---|---|---|---|
| 63-50667 | 3/1988 | Japan . | |
| 2225809 | 6/1990 | United Kingdom | 239/533.12 |

*Primary Examiner*—Andres Kashnikow
*Assistant Examiner*—Lesley D. Morris
*Attorney, Agent, or Firm*—Dennison, Meserole, Pollack & Scheiner

[57] ABSTRACT

An electromagnetic fuel injector including an injector body, a valve housing mounted in a front portion of the injector body and having an injection hole at a front end thereof, a solenoid coil mounted in a rear portion of the injector body, a valve axially movably received in the valve housing, an armature fixed to a rear end portion of the valve, a spring for normally biasing the valve in a valve closing direction, and a nozzle mounted to the front end of the valve housing and having a plurality of atomizer holes communicated with the injection hole of the valve housing. The valve is reciprocated by a magnetic attraction force due to excitation of the solenoid coil and a reaction force of the spring to thereby intermittently inject fuel from the injection hole. An atomizer plate is provided between the nozzle and the injection hole. The atomizer plate has a fuel colliding portion against which the fuel injected from the injection hole collides.

3 Claims, 4 Drawing Sheets

NOZZLE STRUCTURE IN ELECTROMAGNETIC FUEL INJECTOR

BACKGROUND OF THE INVENTION

The present invention relates to a nozzle structure in an electromagnetic fuel injector for use with an engine.

Such a nozzle structure is disclosed in Japanese Patent Laid-open Publication No. 63-50667, for example. A nozzle disclosed in the prior art is employed in an electromagnetic fuel injector for intermittently injecting a liquid fuel from an injection hole by reciprocating a valve movable by a magnetic attraction force due to excitation of a solenoid coil and a reaction force of a spring. The nozzle to be mounted on the front side of the injection hole includes a central columnar portion of a circular cone and three or more atomizer holes arranged about a central axis of the columnar portion at circumferentially equal intervals in such a manner as to be inclined radially outwardly from the central axis of the columnar portion. The columnar portion is formed at its top with a fuel colliding portion against which the fuel injected from the injection hole collides. The fuel colliding portion has a given cross-sectional area in a direction perpendicular to the central axis of the columnar portion. With this structure, the fuel columnarly injected from the injection hole collides with the fuel colliding portion formed at the top of the columnar portion of the nozzle, thus atomizing the fuel and injecting the atomized fuel through the atomizer holes to a given external circular area.

The atomizer holes of the nozzle is formed normally by machining so as to meet a high accuracy, and the fuel colliding portion of the nozzle is accordingly formed by shot blasting the top of the circular cone.

However, in the conventional nozzle having the fuel colliding portion formed by shot blasting, it is hard to suppress variation in shape or size of the fuel colliding portion due to the machining accuracy of the atomizer holes and the shot blasting, causing a problem that the execution of fuel atomization is influenced by the size of the fuel colliding portion. Even in the case that the fuel is atomized, there occurs variation in an atomized condition of the fuel.

SUMMARY OF THE INVENTION

It is an object of the present invention to provide a nozzle structure in an electromagnetic fuel injector which may prevent variation in the fuel atomized condition to be obtained by the fuel colliding portion.

According to the present invention, there is provided in an electromagnetic fuel injector including an injector body, a valve housing mounted in a front portion of said injector body, said valve housing having an injection hole at a front end thereof, a solenoid coil mounted in a rear portion of said injector body, a valve axially movably received in said valve housing, an armature fixed to a rear end portion of said valve, a spring for normally biasing said valve in a valve closing direction, and a nozzle mounted to the front end of said valve housing, said nozzle having a plurality of atomizer holes communicated with said injection hole of said valve housing, wherein said valve is reciprocated by a magnetic attraction force due to excitation of said solenoid coil and a reaction force of said spring to thereby intermittently inject fuel from said injection hole; the improvement comprising an atomizer plate provided between said nozzle and said injection hole, said atomizer plate having a fuel colliding portion against which the fuel injected from said injection hole collides.

With this construction, the fuel columnarly injected from the injection hole of the valve housing by exciting the solenoid coil is allowed to collide with the fuel colliding portion of the atomizer plate. As a result, the fuel after collision is atomized substantially uniformly in the radial direction of the atomizer plate, and is then divided substantially equally to be fed into the plural atomizer holes of the nozzle, thereafter being injected from the atomizer holes to the outside.

As the atomizer plate having the fuel colliding portion is manufactured by pressing a steel blank, for example, independently of the formation of the nozzle, the fuel colliding portion can be formed more highly accurately as compared with the case where it is formed by shot blasting in the prior art. Therefore, the fuel atomization by the fuel colliding portion can be improved, and variation in the fuel atomized condition can be prevented to thereby stabilize the fuel atomization.

The invention will be more fully understood from the following detailed description and appended claims when taken with the drawings.

DETAILED DESCRIPTION OF THE PREFERRED EMBODIMENTS

Figure 1:
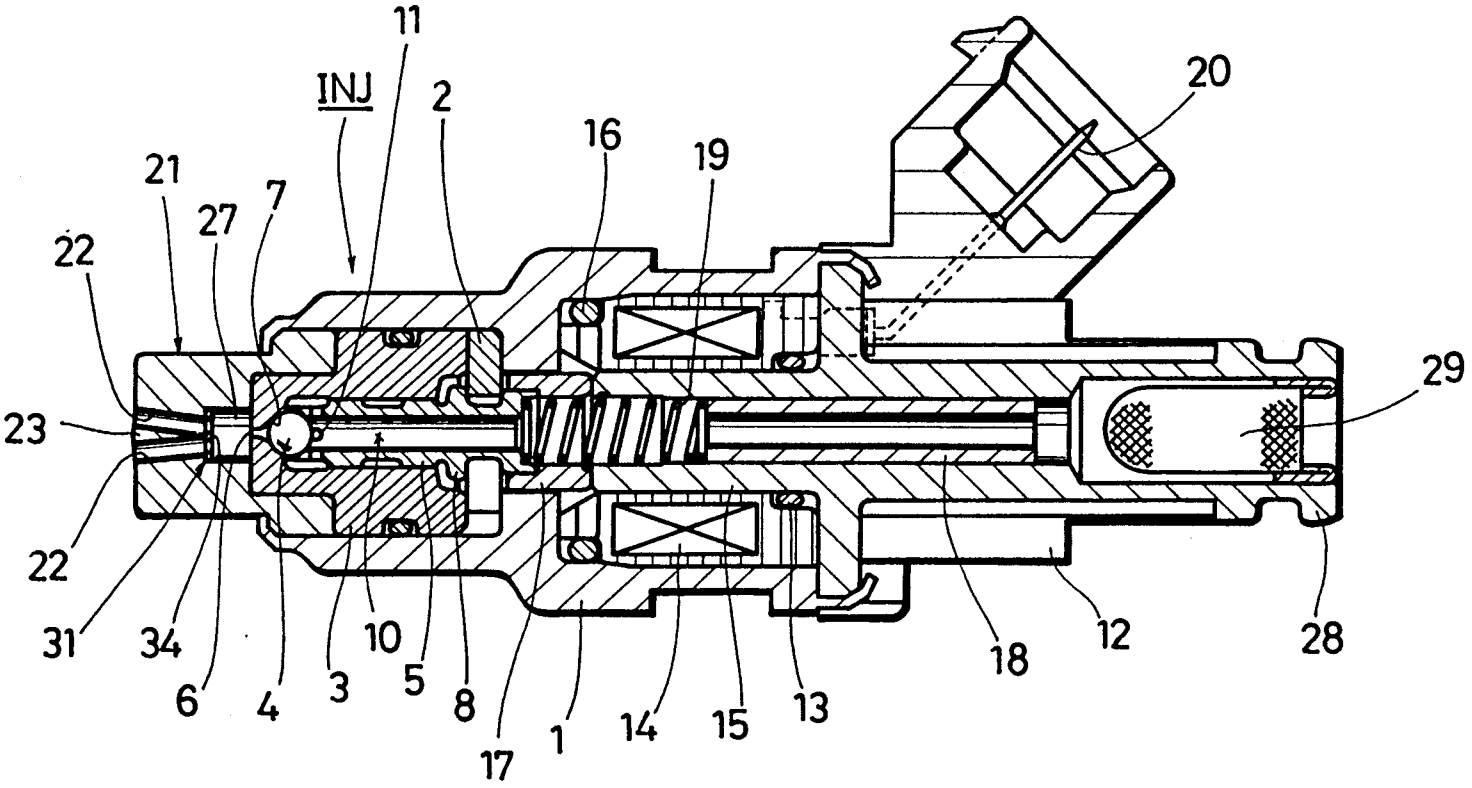
FIG. 1 is a vertical sectional view of an electromagnetic fuel injector employing a first preferred embodiment of the present invention.

Referring first to FIG. 1 which shows an electromagnetic fuel injector INJ employing a first preferred embodiment of the present invention, reference numeral 1 designates an injector body of the electromagnetic fuel injector INJ. A valve housing 3 is mounted through a stopper 2 in a front portion of the injector body 1. The valve housing 3 is formed at its front end with an injection hole 6 and with a curved valve seat 7 around the injection hole 6.

There is installed in the valve housing 3 an axially movable valve 5 having a ball 4 fixed at a front end thereof. The valve 5 is movable in a limited stroke defined between an end surface of the stopper 2 and the valve seat 7 of the valve housing 3. That is, when the valve 5 is moved toward the injection hole 6 until the ball 4 of the valve 5 comes into abutment against the valve seat 7, the injection hole 6 is closed to stop injection of fuel from the injection hole 6. On the other hand, when the valve 5 is moved away from the injection hole 6 until a flange 8 of the valve 5 comes into abutment against the end surface of the stopper 2, the injection hole 6 is opened to inject therefrom the fuel supplied through fuel passages 10 and 11 formed in the valve 5.

A solenoid coil 14 is mounted through an O-ring 16 for preventing fuel leakage in a rear portion of the injector body 1. A fixed iron core 15 formed of a ferromagnetic material is inserted through an O-ring 13 for preventing fuel leakage into the solenoid coil 14. The fixed iron core 15 also serves as a fuel supply pipe. The solenoid coil 14 is electrically connected through a terminal 20 mounted in a connector 12 to an external circuit (not shown).

An armature 17 is fixedly mounted to a rear end portion of the valve 5. The armature 17 is magnetically attracted to the fixed iron core 15 when the solenoid coil 14 is excited.

A fuel supply pipe 18 is fixedly mounted in the fixed iron core 15 after being adjusted in position. A spring 19 is interposed under compression between a rear end of the valve 5 and a front end of the fuel supply pipe 18, so that the valve 5 with the armature 17 is normally biased by the spring 19 leftwardly as viewed in FIG. 1 to bring the ball 4 of the valve 5 into abutment against the valve seat 7 of the valve housing 3.

A strainer 29 is mounted in a plug 28 formed at a rear end portion of the fixed iron core 15, and a fuel supply hose (not shown) is connected to the plug 28.

Figure 2:
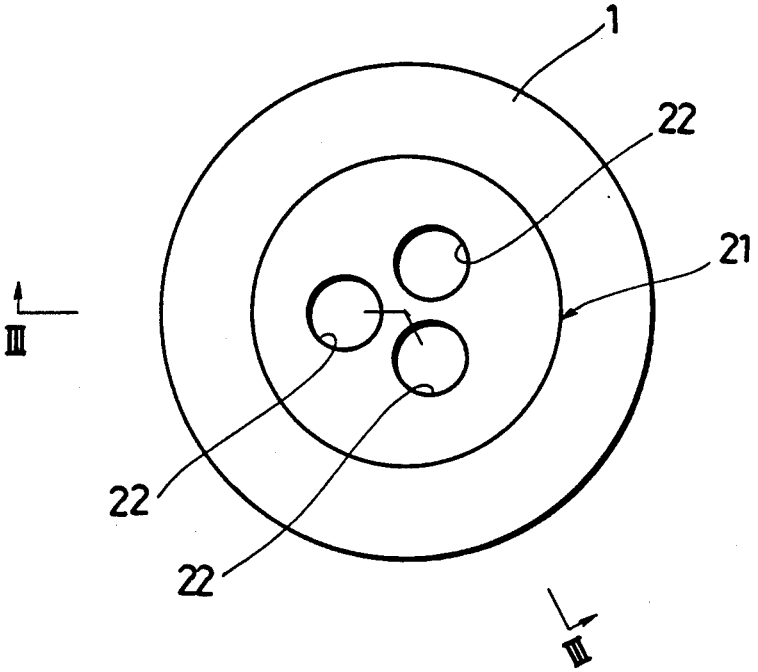
FIG. 2 is an elevational view of a nozzle shown in FIG. 1.
Figure 3:
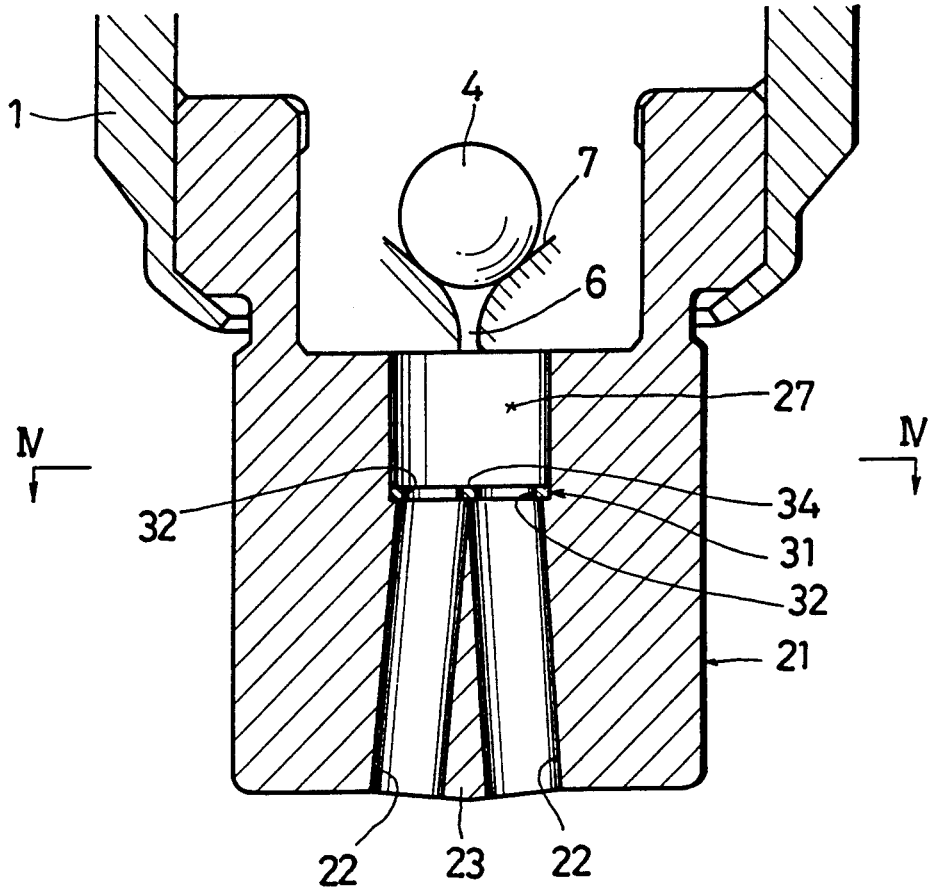
FIG. 3 is a cross section taken along the line III—III in FIG. 2.

Referring next to FIGS. 2 and 3 in addition to FIG. 1, reference numeral 21 designates a nozzle fixedly mounted to the front end of the valve housing 3 by caulking a front end of the injector body 1.

The nozzle 21 is formed at its axial center with a columnar portion 23 and with three fuel atomizer holes 22 arranged at circumferentially equal intervals about the axial center of the columnar portion 23 and extending inclinedly outwardly. The fuel columnarly injected from the injection hole 6 is atomized in the nozzle 21, and is then supplied through the fuel atomizer holes 22 to an external circular area at a predetermined distance.

The nozzle 21 is formed with a central bore 27 just downstream of the injection hole 6 of the valve housing 3, and upstream openings of the atomizer holes 22 join together at the bottom of the central bore 27.

A circular atomizer plate 31 is fixed by press fitting or partial caulking to the bottom of the central bore 27, that is, the joining portion of the atomizer holes 22.

Figure 4:
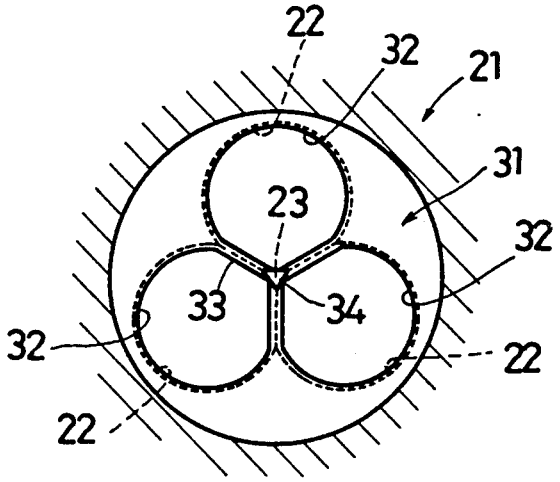
FIG. 4 is a cross section taken along the line IV–IV in FIG. 3.
Figure 5:
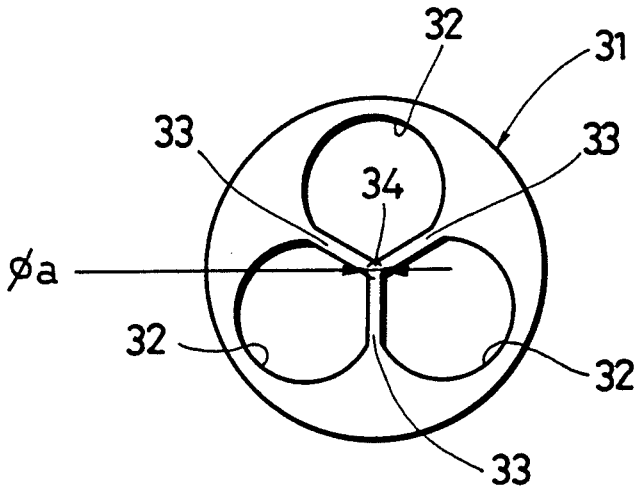
FIG. 5 is a plan view of an atomizer plate shown in FIG. 1.

Referring further to FIGS. 4 and 5, the circular atomizer plate 31 has three fuel atomizer apertures 32 arranged at circumferentially equal intervals and aligned to the upstream openings of the atomizer holes 22 of the nozzle 21. The three atomizer apertures 32 are partitioned by three narrow parting portions 33 extending radially outwardly from the central area of the atomizer plate 31. There is formed at the central area of the atomizer plate 31 a fuel colliding portion 34 against which the fuel columnarly injected from the injection hole 6 of the valve housing 3 collides so as to atomize the fuel.

As shown in FIG. 5, the fuel colliding portion 34 has a predetermined area as defined by an inscribed circle having a diameter $\phi a$. As shown in FIG. 4, the top of the columnar portion 23 of the nozzle 21 is covered with the fuel colliding portion 34 and the parting portions 33. Further, a shape of each atomizer aperture 32 of the atomizer plate 31 is similar to that of the upstream opening of each atomizer hole 22 of the nozzle 21, and an opening area of each atomizer aperture 32 is slightly smaller than that of the upstream opening of each atomizer hole 22.

The atomizer plate 31 is formed by pressing or punching a steel blank, for example. Therefore, the fuel colliding portion 34 of the atomizer plate 31 can be formed more highly accurately and easily than the case where it is formed by shot blasting in the prior art. Further, the atomizer holes 32 can be formed with a high accuracy.

In operation, when the solenoid coil 14 is not excited, the valve 5 is closed by the biasing force of the spring 19, and accordingly the fuel supplied from the fuel supply hose through the fixed iron core into the fuel passages in the valve 5 is not injected from the injection hole 6. On the other hand, when the solenoid coil 14 is excited, the armature 17 is magnetically attracted to the fixed iron core 15 against the biasing force of the spring 19, and the valve 5 is accordingly opened. As a result, the fuel supplied from the fuel supply hose is columnarly injected under a metered condition from the injection hole 6 into the central bore 27 of the nozzle 21.

Then, the fuel injected from the injection hole 6 collides with the fuel colliding portion 34 of the atomizer plate 31. As a result, the fuel is atomized to be equally divided into three parts by the parting portions 33 which are in turn fed through the atomizer apertures 32 of the atomizer plate 31 and the atomizer holes 22 of the nozzle 21. Finally, the atomized fuel is injected from the atomizer holes 22 to the outside.

An atomized condition of the fuel to be obtained by the atomizer plate 31 is influenced by the size of the fuel colliding portion 34 of the atomizer plate 31. That is, if the diameter $\phi a$ of the inscribed circle forming the fuel colliding portion 34 is too small, the fuel will not be atomized. For instance, it is preferable that the diameter $\phi a$ of the inscribed circle forming the fuel colliding portion 34 is set to 0.1 mm or more in the case that the diameter of the injection hole 6 is set to 0.4 mm.

Figure 6:
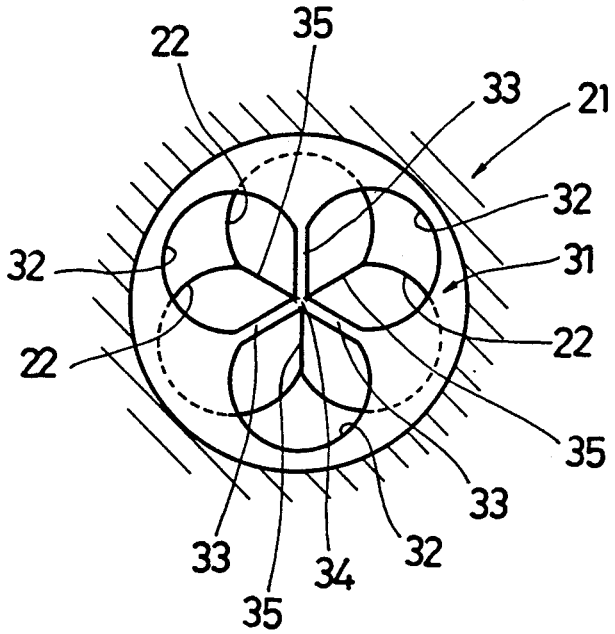
FIG. 6 is a view similar to FIG. 4, showing a second preferred embodiment of the present invention.

Referring next to FIG. 6 which shows a second preferred embodiment of the present invention, the atomizer plate 31 is fixed to the nozzle 21 in such a manner that the atomizer apertures 32 of the atomizer plate 31 are circumferentially shifted at about 60 degrees from the upstream openings of the atomizer holes 22 of the nozzle 21. The other construction is the same as the construction of the first preferred embodiment, and the explanation thereof will be omitted hereinafter. The same parts as those in the first preferred embodiment are designated by the same reference numerals.

As shown in FIG. 6, each parting portion 33 of the atomizer plate 31 is arranged at substantially the central position of the upstream opening of each atomizer hole 22 of the nozzle 21. That is, the upstream opening of each atomizer hole 22 is partitioned by each parting portion 33 of the atomizer plate 31. As similar to the first preferred embodiment, the top of the columnar portion 23 of the nozzle 21 is covered with the fuel colliding portion 34 of the atomizer plate 31.

According to the construction of the second preferred embodiment, the fuel injected from the injection hole 6 collides with the fuel colliding portion 34, and is atomized. Then, the atomized fuel is divided into three parts by the parting portions 33 of the atomizer plate 31. Then, each part of the atomized fuel is further divided into two parts by each partition 35 of the columnar portion 23 of the nozzle 21, thereafter being fed into the corresponding atomizer hole 22. Accordingly, the atomization of the fuel can be more improved as compared with the first preferred embodiment.

Having thus described the preferred embodiments of the invention, it should be understood that numerous structural modifications and adaptations may be made without departing from the spirit of the invention.

What is claimed is:

1. In an electromagnetic fuel injector including an injector body, a valve housing mounted in a front portion of said injector body, said valve housing having an injection hole at a front end thereof, a solenoid coil mounted in a rear portion of said injector body, a valve axially movably received in said valve housing, an armature fixed to a rear end portion of said valve, a spring for normally biasing said valve in a valve closing direction, and a nozzle mounted to the front end of said valve housing, said nozzle having a plurality of atomizer holes communicated with said injection hole of said valve housing, wherein said valve is reciprocated by a magnetic attraction force due to excitation of said solenoid coil and a reaction force of said spring to thereby intermittently inject fuel from said injection hole; the improvement comprising an atomizer plate provided between said nozzle and said injection hole, said atomizer plate having a plurality of atomizer apertures arranged at circumferentially equal intervals, parting portions for parting said atomizer apertures and a fuel colliding portion formed at a central junction area of said parting portions against which the fuel injected from said injection hole collides, wherein each of said atomizer apertures has a shape similar to that of each of said upstream openings of said atomizer holes, and has an opening area slightly smaller than that of each upstream opening of said atomizer holes.

2. In an electromagnetic fuel injector including an injector body, a valve housing mounted in a front portion of said injector body, said valve housing having an injection hole at a front end thereof, a solenoid coil mounted in a rear portion of said injector body, a valve axially movably received in said valve housing, an armature fixed to a rear end portion of said valve, a spring for normally biasing said valve in a valve closing direction, and a nozzle mounted to the front end of said valve housing, said nozzle having a plurality of atomizer holes communicated with said injection hole of said valve housing, wherein said valve is reciprocated by a magnetic attraction force due to excitation of said solenoid coil and a reaction force of said spring to thereby intermittently inject fuel from said injection hole; the improvement comprising an atomizer plate provided between said nozzle and said injection hole, said atomizer plate having a plurality of atomizer apertures arranged at circumferentially equal intervals, parting portions for parting said atomizer apertures and a fuel colliding portion formed at a central junction area of said parting portions against which the fuel injected from said injection hole collides, wherein said atomizer apertures of said atomizer plate are aligned to upstream openings of said atomizer holes of said nozzle.

3. In an electromagnetic fuel injector including an injector body, a valve housing mounted in a front portion of said injector body, said valve housing having an injection hole at a front end thereof, a solenoid coil mounted in a rear portion of said injector body, a valve axially movably received in said valve housing, an armature fixed to a rear end portion of said valve, a spring for normally biasing said valve in a valve closing direction, and a nozzle mounted to the front end of said valve housing, said nozzle having a plurality of atomizer holes communicated with said injection hole of said valve housing, wherein said valve is reciprocated by a magnetic attraction force due to excitation of said solenoid coil and a reaction force of said spring to thereby intermittently inject fuel from said injection hole; the improvement comprising an atomizer plate provided between said nozzle and said injection hole, said atomizer plate having a plurality of atomizer apertures arranged at circumferentially equal intervals, parting portions for parting said atomizer apertures and a fuel colliding portion formed at a central junction area of said parting portions against which the fuel injected from said injection hole collides, wherein said atomizer apertures of said atomizer plate are circumferentially shifted at a predetermined angle from upstream openings of said atomizer holes of said nozzle.

* * * * *